United States Patent [19]

Sharp

[11] Patent Number: 5,017,044

[45] **Date of Patent: * May 21, 1991**

[54] FIBROUS REINFORCED RESINOUS STORAGE TANKS WITH STRENGTHENED WALLS

[76] Inventor: Bruce R. Sharp, 4090 Rose Hill Ave., Cincinnati, Ohio 45229

[ * ] Notice: The portion of the term of this patent subsequent to May 15, 2007 has been disclaimed.

[21] Appl. No.: 343,859

[22] Filed: Apr. 26, 1989

[51] Int. Cl.[5] ..... B65D 87/00; B65D 6/34; B65D 8/08; B65G 5/00

[52] U.S. Cl. ..... 405/53; 405/55; 220/4.12; 220/4.13; 220/648; 220/469

[58] Field of Search ..... 405/53, 55; 220/1 B, 220/5 A, 3, 71, 72, 469, 4.13, 4.12, 646, 648, 675

[56] References Cited

U.S. PATENT DOCUMENTS

| | | | |
|---|---|---|---|
| 1,927,255 | 9/1933 | Brown | 220/71 X |
| 2,144,945 | 1/1939 | Sutton | 220/71 |
| 2,373,270 | 4/1945 | Skolnik | 220/71 X |
| 2,607,509 | 8/1952 | Hess | 220/72 X |
| 3,191,792 | 6/1965 | Hunt | 220/3 |
| 3,335,903 | 8/1967 | Anderson | 220/83 |
| 3,335,904 | 8/1967 | Anderson | 220/71 X |
| 3,700,512 | 10/1972 | Pearson et al. | 156/62.4 |
| 4,549,672 | 10/1985 | Rinkewich | 220/469 X |
| 4,561,292 | 12/1985 | Pugnale et al. | 73/49.2 |
| 4,925,046 | 5/1990 | Sharp | 220/5 A |

OTHER PUBLICATIONS

"Xerxes Corporation Tanks Meet Regulations", *Petroleum Marketer,* Nov.-Dec., 1985, pp. 35-36.

*Primary Examiner*—Dennis L. Taylor
*Assistant Examiner*—John Ricci
*Attorney, Agent, or Firm*—Charles R. Wilson

[57] ABSTRACT

A method of making a storage tank system comprises forming a cylindrical-shaped inner tank with integral support ribs and forming a series of interior wall sections which are at least partially separated from the tank's walls between each set of support ribs. Each wall section is preferably bonded to the side walls of adjoining ribs. The walls of the storage tank are strengthened by the support ribs and wall sections.

17 Claims, 2 Drawing Sheets

FIBROUS REINFORCED RESINOUS STORAGE TANKS WITH STRENGTHENED WALLS

This invention relates to storage tanks. More particularly, the invention relates to ribbed underground storage tanks.

BACKGROUND OF THE INVENTION

Commercial and industrial storage tanks are widely used for the bulk storing of liquids. The storage tanks are typically made of steel or fiberglass reinforced resin. The walls of the tanks range up to an inch thick depending on the tank's capacity. Such a thickness and resultant strength is needed because of the tremendous amount of forces exerted on the walls of the tank by the weight of the stored liquid as well as ground movements. Complete tank failure can occur by forces being so great as to buckle a wall. Since many of the liquids commonly stored are highly corrosive and/or are flammable, they pose a significant health and safety hazard if not properly contained.

Tanks made from fiberglass reinforced resinous material are extensively used. Different methods are used for making these tanks. One commercial method of making tanks from fiberglass reinforced resinous material utilizes a removable split half-mold with shapes for forming the support ribs and end cap along with the main body. After fiberglass and resinous material are applied to the mold and cured, the mold is removed. Next, the interior portions of the rib areas are filled with a filler material or bridged over with a cardboard insert and fiberglass/resin applied so as to form a substantially smooth tank interior. The weakest part of such a tank is in the body portion or non-ribbed area of the tank. Any failure in this area will likely lead to a sudden large leak.

Recent concerns about leaked tanks have increased the need for an efficient and economical manner of building a reliable storage tank system. In accord with this need, there has now been discovered a method whereby strengthened storage tanks are built in an efficient, yet economical manner.

SUMMARY OF THE INVENTION

A method of building a strengthened ribbed storage tank system utilizes as a inner tank a cylindrical-shaped tank having a set of integral spaced ribs extending circumferentially around the tank. A strengthened wall is formed by providing a series of interior wall sections which are at least partially separated from the inner tank's walls between each set of spaced support ribs. Each wall section is bonded at or near to the interior side walls of the support ribs.

DETAILED DESCRIPTION OF THE INVENTION

Figure 1:
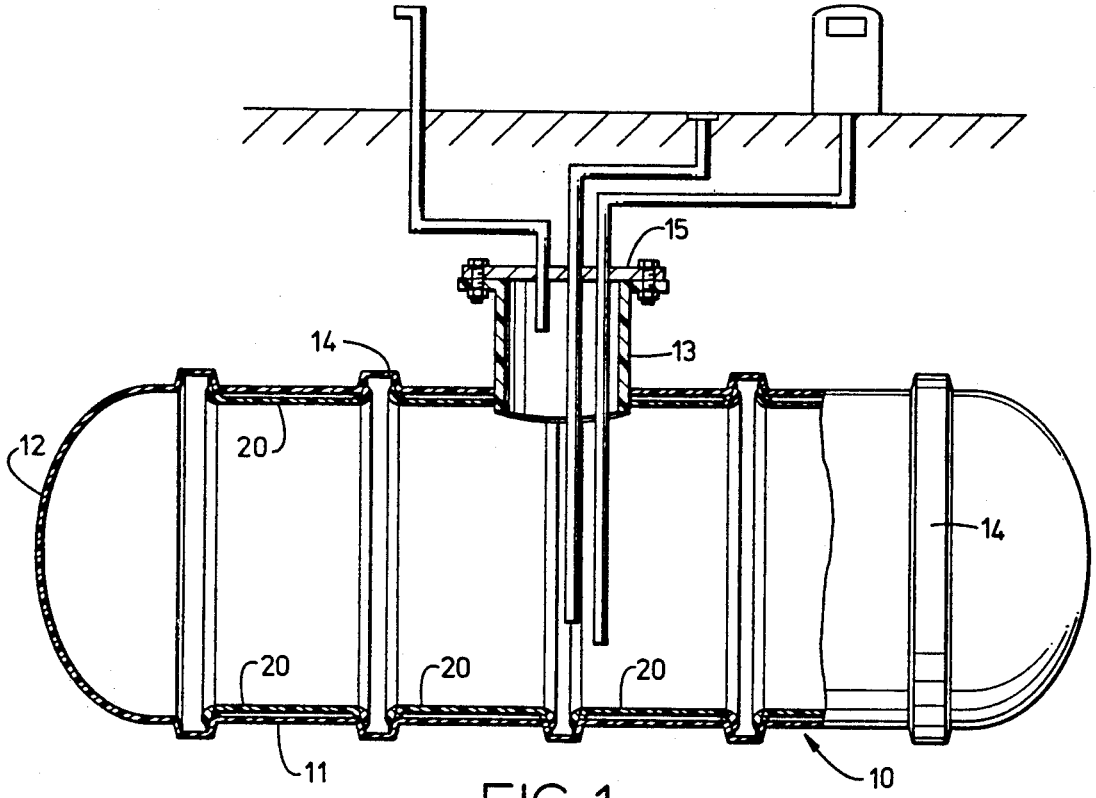
FIG. 1 is a side view of a ribbed storage tank system having support ribs and interior wall sections over tank areas between the ribs.

With reference to FIG. 1, there is shown a storage tank 10. The basic storage tank of the type shown in FIG. 1 upon which this invention is an improvement is well known and is widely used, especially in the gasoline service station industry. Such tanks comprise a cylindrical-shaped main body 11, end caps 12, and manhead 13. The tank is made of a conventional fibrous reinforced resinous material. Ribs 14 substantially evenly spaced along the length of main body 11 are an integral part of the tank. That is, the storage tank is made by a method wherein the cylindrical-shaped main body 11 and ribs 14 are formed together on a removable mold. End caps 12 can be formed separately and bonded to the main body of the tank in a distinct step or formed with the main body 11.

A sufficient number of openings are found in the storage tank 11 to allow for various access lines to the interior of the tank. For instance, a fill pipe, dispensing line and vent pipe can enter the storage tank at various points in the tank's surface, but preferably all enter through cover 15 and manhead 13. The storage tank as described is commercially available.

In accord with this invention, a series of wall sections are bonded to the interior of the tank. Each section is at least partially separated in a mid portion from the interior wall of the tank. Because of manufacturing difficulties, portions of the wall sections may contact the tank wall. Such contact is not detrimental to the storage tank system's performance and in fact is preferred provided the two walls remain at least partially separated for composite strengthening. The wall sections are about eight inches to about sixty inches wide depending on the tank's rib spacings. Preferably, the wall sections substantially cover that area between adjoining ribs.

Figure 2:
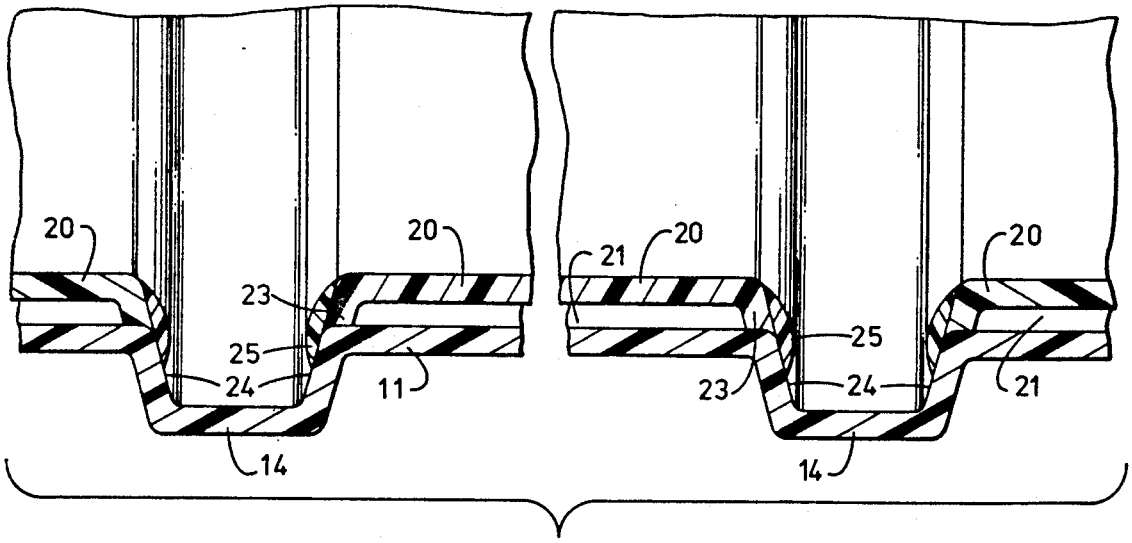
FIG. 2 is an enlarged sectional view of two support ribs found on the storage tank system of FIG. 1.

One method of forming the interior wall sections 20 and which is illustrated in FIGS. 1 and 2 is to place solid sheet material between the ribs. Examples of such solid sheet materials include metal sheets and fiberglass/resin sheets. The metal sheet can be a thin gauge steel sheet with a diamond grid pattern on the surface which faces the inner tank. The fiberglass resin sheet preferably has a stucco appearance on the side facing the inner tank. It is, thus, preferred that the solid sheet material has an irregular surface on at least one side to ensure a seal is not formed by its contact with the inner tank walls.

The wall section 20 substantially covers the area 21 between two adjoining ribs. Edges 23 of the sheet material are bonded near to a rib recess, preferably on the side wall 24 of the rib itself. Maximum tank strength is achieved by bonding the wall sections to side walls of the ribs.

The bonding technique used to secure the wall sections to the side walls of the support ribs will depend on the materials of construction of the sections, per se. Preferably, the wall sections are made of a fibrous reinforced resinous material. In this case, additional resinous material 25 is used for the bonding purpose.

The ribs 14 strengthen the inner tank 11. The wall sections 20 greatly increases the strength of the main body 11 walls of the tank. The result is a storage tank system which is economically built with a minimum of labor intensive steps and which has sufficient strength without excessive wall thickness to meet or exceed mandated structural requirements. The walls of the storage tank system are both able to withstand internal and external load forces encountered during use.

Figure 3:
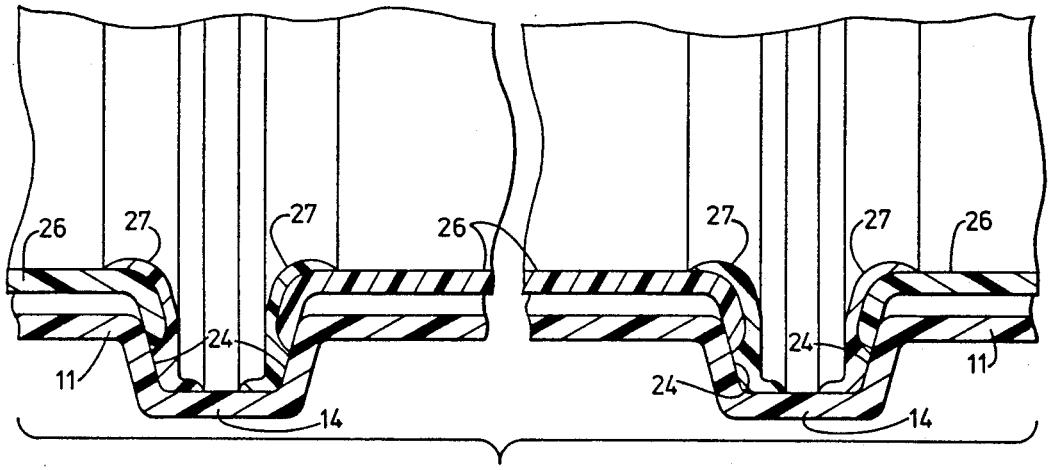
FIG. 3 is a partial side view of a wall section of a ribbed storage tank system wherein interior wall sections are bonded to side walls of a rib recess.

FIG. 3 illustrates an embodiment of the invention where a wall section 26 abuts against side walls 24 of a rib. An overlay 27 of resinous material bonds the wall section to the side walls. Overlay 27 extends into the rib recess and actually adds some strength thereto.

Figure 4:
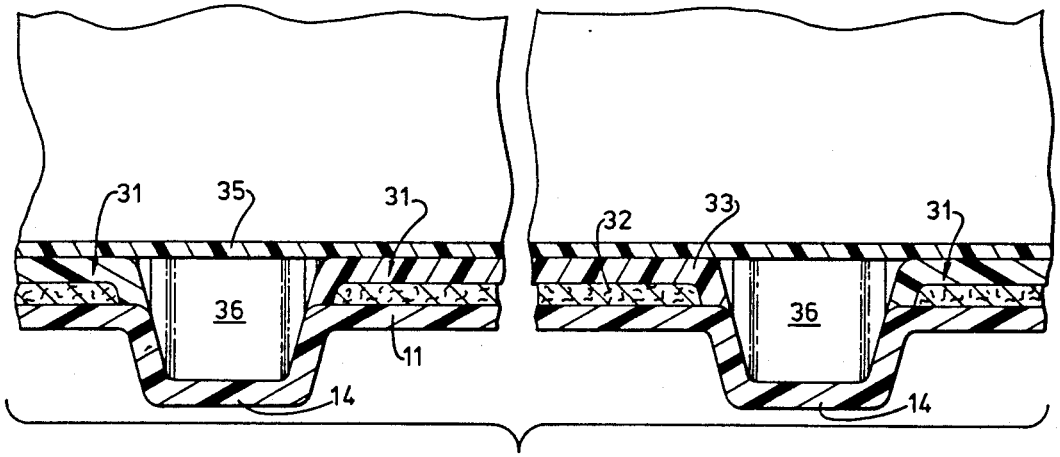
FIG. 4 is a partial side view of a wall section of another storage tank system of this invention wherein wall sections are added to the tank areas between the ribs and a smooth interior surface is provided.

FIG. 4 illustrates a tank having wall sections made of a fibrous reinforced resinous material. The wall sections 31 are formed in one method by first applying layers of fibrous reinforcing material 32, e.g. fiberglass on the interior surface of the main body 11 between the ribs. The fibrous reinforcing material can take on many different physical shapes and structures, variously referred to as mattings, nets, screens, meshes, and chopped strands. Examples of fibrous materials include fiberglass, nylon, and other synthetic fibrous materials. The fibrous material, if in sheet form, is laid onto the wall areas as a continuous matting. The thickness of the fibrous material is great enough that a subsequently applied resinous material as discussed in the following paragraph will not be able to completely penetrate through it and seal to the tank 11.

Once the fibrous reinforcing material is applied, a resinous material 33 is next applied to the reinforcing material and thereafter cured. Several different resinous materials are known for the purpose of reinforcing fibrous material. Such materials include polyesters, e.g. vinylesters, isophthalic polyesters, polyethylene, polypropylene, polyvinylchloride, polyurethane, and polyepoxide. The listed resinous materials used in the construction of the wall sections are not all inclusive, but only illustrative of some of the resinous materials which can be used.

Alternatively, the fibrous material is applied in the form of chopped strands along with the resinous materials described in the previous paragraph. In this embodiment, a separating material discussed in following paragraphs must be applied to the interior wall of tank to keep the walls separated. Thus, the chopped strand and resinous material are sprayed from separate nozzles of the same spray gun and the wall sections formed therefrom on the separating material as the resin cures. Necessarily, there will be some overlap of spray materials into the support rib recesses. This is beneficial in that the ribs are thereby strengthened. Still another method of forming the wall sections is by filament windings. In this method continuous reinforcing fibrous strands are impregnated with resinous material and then wrapped in a crossing pattern over the interior wall. A separating material must be used in this method.

When needed, a separating material having an impervious outer planar surface is applied to the surface area on the tank's surface between the ribs. The purpose of the separating material is to ensure that the subsequently applied fibrous reinforcing material and resinous material which form the wall sections 31 will not seal to the inner storage tank.

Separating materials include solid polymeric films as well as foraminous or porous materials which are preferably sealed on at least one side. Many pliable or semirigid materials are usable. Examples of such material are polyethylene, jute, polyurethane foam, polyester foam, polyether foam, fiberglass matting, cotton matting, nylon matting, corrugated cardboard, and asbestos which range from about 0.01 inches to almost 1.0 inch in thickness. A heat seal or sealing material, e.g. a polymeric coating, is used on one surface of any foraminous materials when needed to prevent substantial saturation with a subsequently applied resinous material. Wax, which is subsequently heated and removed, is also used as a separating material.

In the embodiment of the invention discussed with reference to FIG. 4, the continuous sheet of fibrous material 32 serves the dual function of being a separating material and a part of a wall section. The sheet of material is about 0.05 inches to about 1.5 inches thick. A resinous material applied to the top surface of the fibrous material forms the wall sections 31 and is bonded to the support ribs. Complete penetration of resin into the fibrous material is avoided. In effect the portion of the fibrous material sheet adjacent the tank is a separating material and the top surface portion together with the resinous material forms the wall sections.

The minimum thickness of the separating material must be sufficient to prevent the subsequently applied wall section from adhering to the storage tank. Accordingly, any shrinkage resulting from formation of the wall sections must be accounted for by having a sealed sheet material thick enough to be partially collapsed, but not compressed to a sealed condition.

Still with reference to FIG. 4, there is shown the storage tank wherein a smooth interior wall has been formed. The tank is modified by adding a smooth continuous wall 35 over the wall sections 31 and the rib recesses 36. The purpose of this wall is to ensure no liquid traps are present where the stored liquid will flow. A 20 fibrous reinforced resinous material is preferably used to form wall 35. For ease of manufacturing the rib recesses 36 can be filled with an inert material prior to forming the wall 35.

While the invention has been described with respect to preferred embodiments, it is understood that various modifications may be made without departing from the spirit of the subject invention as defined by the appended claims. All obvious variations are within the scope of the claims.

What is claimed is:

1. A method of building a strengthened ribbed underground storage tank system from a storage tank formed of a fibrous reinforced resinous material, said storage tank having a cylindrical-shaped main body, end caps and a set of substantially evenly spaced support ribs along the length of the main body which extend circumferentially around said main body and are integral therewith, further wherein said storage tank's interior wall is generally contoured with rib recesses, the improvement comprising bonding a series of wall sections circumferentially around the interior wall of the storage tank to substantially cover interior wall areas between the rib recesses, said wall sections being at least partially separated from the interior wall areas.

2. The method of claim 1 wherein edges of each wall section are attached at the side walls of the rib recesses.

3. The method of claim 2 wherein each wall section is formed substantially in contact with the interior wall of the storage tank, yet not sealed thereto in a liquid tight fashion.

4. The method of claim 1 wherein each wall section is from about eight inches to about sixty inches in width.

5. The method of claim 1 wherein the wall sections are formed of a fibrous reinforced resinous material.

6. The method of claim 1 further comprising the step of placing a separating material on the interior of the tank walls over which the wall sections are to be formed, thereby providing a means whereby the mid sections of the wall sections remain structurally independent of the tank.

7. The method of claim 6 wherein the separating material is a foam, matting, net, screen or mesh and a surface nearest the wall section is sealed.

8. The method of claim 1 wherein the wall sections are formed from solid sheet materials.

9. The method of claim 1 further comprising the step of forming a smooth continuous wall over the interior of the tank after attaching the wall sections to prevent liquid accumulations.

10. The method of claim 9 wherein the rib recesses are first substantially filled with an inert material prior to forming the smooth continuous surface.

11. A strengthened ribbed underground storage tank system, comprising:

(a) a fibrous reinforced resinous storage tank having a cylindrical-shaped main body, end caps and a set of substantially evenly spaced support ribs along the length of the main body which extend circumferentially around the main body and are integral therewith, further wherein said storage tank's interior wall is generally contoured with rib recesses; and (b) a series of wall sections extending circumferentially around the interior wall of the storage tank to substantially cover interior wall areas between the rib recesses, said wall sections being at least partially separated from the interior wall areas.

12. The storage tank system of claim 11 wherein the wall sections are made of fibrous reinforcing material and resinous material.

13. The storage tank system of claim 12 wherein the storage tank's interior wall between rib recesses has a separating material positioned thereon to provide a means whereby the wall sections remain independent of the tank.

14. The storage tank system of claim 13 wherein the separating material is sealed on at least one side.

15. The storage tank system of claim 14 wherein the separating material is a foam, matting, net, screen or mesh which has been sealed on its outer surface.

16. The storage tank system of claim 12 wherein the wall sections are bonded to the side walls of the support ribs.

17. The storage tank system of claim 11 wherein the wall sections are made from solid sheet materials.

* * * * *

Disclaimer 5,017,044 — Bruce R. Sharp, Cincinnati, Ohio. FIBROUS REINFORCED RESINOUS STORAGE TANKS WITH STRENGTHENED WALLS. Patent dated May 21, 1991. Disclaimer filed Jan. 14, 1997, by the inventor.

The term of this patent shall not extend beyond the expiration date of Pat. No. 4,739,659.

*(Official Gazette,* April 22, 1997)